US012043459B2

(12) United States Patent
Harris et al.

(10) Patent No.: US 12,043,459 B2
(45) Date of Patent: Jul. 23, 2024

(54) DRINKING VESSEL WITH LID AND LOCKING COVER

(71) Applicant: Base Brands, LLC, Atlanta, GA (US)

(72) Inventors: Jamison Corey Harris, Brookhaven, GA (US); Patrick Spivey, Atlanta, GA (US); Kenneth Kreafle, Atlanta, GA (US)

(73) Assignee: Base Brands, LLC, Atlanta, GA (US)

( * ) Notice: Subject to any disclaimer, the term of this patent is extended or adjusted under 35 U.S.C. 154(b) by 0 days.

(21) Appl. No.: 17/704,964

(22) Filed: Mar. 25, 2022

(65) Prior Publication Data

US 2023/0303298 A1 Sep. 28, 2023

(51) Int. Cl.

| | |
|---|---|
| ***B65D 55/02*** | (2006.01) |
| ***B65D 41/04*** | (2006.01) |
| ***B65D 43/02*** | (2006.01) |
| ***B65D 43/22*** | (2006.01) |
| ***B65D 43/26*** | (2006.01) |
| ***B65D 47/08*** | (2006.01) |

(52) U.S. Cl.

CPC ..... *B65D 55/02* (2013.01); *B65D 41/04* (2013.01); *B65D 43/0225* (2013.01); *B65D 43/22* (2013.01); *B65D 43/26* (2013.01); *B65D 47/08* (2013.01); *B65D 2205/02* (2013.01); *B65D 2543/00046* (2013.01); *B65D 2543/00231* (2013.01)

(58) Field of Classification Search

CPC ..... B65D 43/267; B65D 43/26; B65D 41/28; B65D 41/04; B65D 47/08; A47G 19/2272

USPC ..... 220/711, 713, 715; 215/307, 311, 315, 215/387, 201

See application file for complete search history.

(56) References Cited

U.S. PATENT DOCUMENTS

| | | | | |
|---|---|---|---|---|
| 5,938,053 | A * | 8/1999 | Verbovszky | A47G 19/2272 215/11.4 |
| 8,191,727 | B2 * | 6/2012 | Davies | B65D 51/242 220/709 |
| 8,573,431 | B2 * | 11/2013 | Shepard | B65D 47/249 220/254.1 |
| 8,746,496 | B2 * | 6/2014 | Gilbert | B65D 43/18 220/203.23 |
| 8,985,370 | B2 * | 3/2015 | Lane | B65D 43/26 220/252 |
| 9,282,838 | B2 * | 3/2016 | Sims | B65D 47/32 |

(Continued)

*Primary Examiner* — Steven A. Reynolds
*Assistant Examiner* — Prince Pal
(74) *Attorney, Agent, or Firm* — Park, Vaughan, Fleming & Dowler LLP

(57) ABSTRACT

Described herein are embodiments of systems and apparatuses that include a drinking vessel with a lid and locking cover. In an embodiment, the apparatus includes a container and a lid, where the lid is configured to engage an opening of a container to retain the liquid within the container. The lid may further include a cover capable of moving between a first and second position, where the contents of the container are accessible in the lid's second position but not the lid's first position. The lid may further include an adjustable lock capable of movement between at least a closed position and an open position. When the adjustable lock is in its closed position, the lid's cover is not able to move between its first and second position. When the adjustable lock is in its open position, the lid's cover is able to move between it first and second position.

12 Claims, 9 Drawing Sheets

(56) References Cited

U.S. PATENT DOCUMENTS

| | | | | |
|---|---|---|---|---|
| 10,994,902 | B2 * | 5/2021 | Cheng | A47G 19/2266 |
| 11,447,308 | B1 * | 9/2022 | Lin | B65D 47/20 |
| 2007/0210093 | A1 * | 9/2007 | Pinelli | B65D 43/20 220/715 |
| 2013/0062304 | A1 * | 3/2013 | Meyers | B65D 47/0871 215/240 |
| 2013/0119060 | A1 * | 5/2013 | Chiou | B65D 47/26 220/254.1 |
| 2014/0175098 | A1 * | 6/2014 | Lane | A45F 3/18 220/212.5 |
| 2014/0263476 | A1 * | 9/2014 | Blain | B65D 43/16 222/545 |
| 2015/0164255 | A1 * | 6/2015 | Coon | B65D 43/16 220/254.1 |
| 2017/0144809 | A1 * | 5/2017 | Sorensen | B65D 43/16 |
| 2018/0222641 | A1 * | 8/2018 | Gilbert | B65D 43/26 |
| 2020/0039706 | A1 * | 2/2020 | Gilbert | B65D 47/249 |
| 2020/0391910 | A1 * | 12/2020 | Pinelli | A47G 19/2272 |
| 2021/0086963 | A1 * | 3/2021 | Siegenthaler | B65D 47/2062 |
| 2021/0171248 | A1 * | 6/2021 | Hawes | B65D 47/0847 |
| 2022/0033148 | A1 * | 2/2022 | Filiau | B65D 47/305 |
| 2023/0029205 | A1 * | 1/2023 | Omdahl, II | A47G 19/2222 |

* cited by examiner

DRINKING VESSEL WITH LID AND LOCKING COVER

FIELD OF THE INVENTION

This disclosure generally relates to drinking vessels and, more specifically, to a drinking vessel with a lid and a locking cover.

BACKGROUND

Drinking vessels, such as cups, insulated beverage containers, canteens, and the like are used to contain fluids for drinking. Fluids tend to spill if left in an open container, so many drinking vessels include a lid. Some lids include openings for allowing controlled passage of the fluid to a user of the vessel. In some cases, the opening is a hole or slot through which the fluid flows. In such circumstances it can be advantageous to provide a cover for the opening so that fluid does not inadvertently spill from the container. Problems abound with such covers. For example, they can be inconvenient when a user wants to drink from the container; they can become dislodged and fail their purpose of preventing spills; and, they can become dirty or contaminated over time. Addressing these problems in a unique manner is the subject of the present application.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is later discussed.

Described herein are embodiments of systems and apparatuses that include a drinking vessel with a lid and a locking cover. In an embodiment, an apparatus includes a container and a lid, where the lid is configured to engage an opening of a container to retain the liquid within the container. The lid may further include an opening through which liquids in the container can pass. The lid my further include a cover that, in a first position, seals the opening so as to prevent liquid from exiting the container (including spills) and that, in a second position, allows liquid to exit the container. An embodiment may also include an adjustable lock on the lid that can be variously positioned to (1) lock or otherwise securely maintain the cover in its first position, (2) allow the cover rotate between its first and its second position, and/or (3) be positioned for cleaning purposes. The adjustable lock can also be completely removed from the lid, in which case the cover can be manually positioned in its first or second position. The details of various exemplary embodiments are described below.

BRIEF DESCRIPTION OF THE DRAWINGS

The disclosure may be understood by reference to the following description taken in conjunction with the accompanying drawings, in which like reference numerals identify like elements, and in which.

Figure 1:
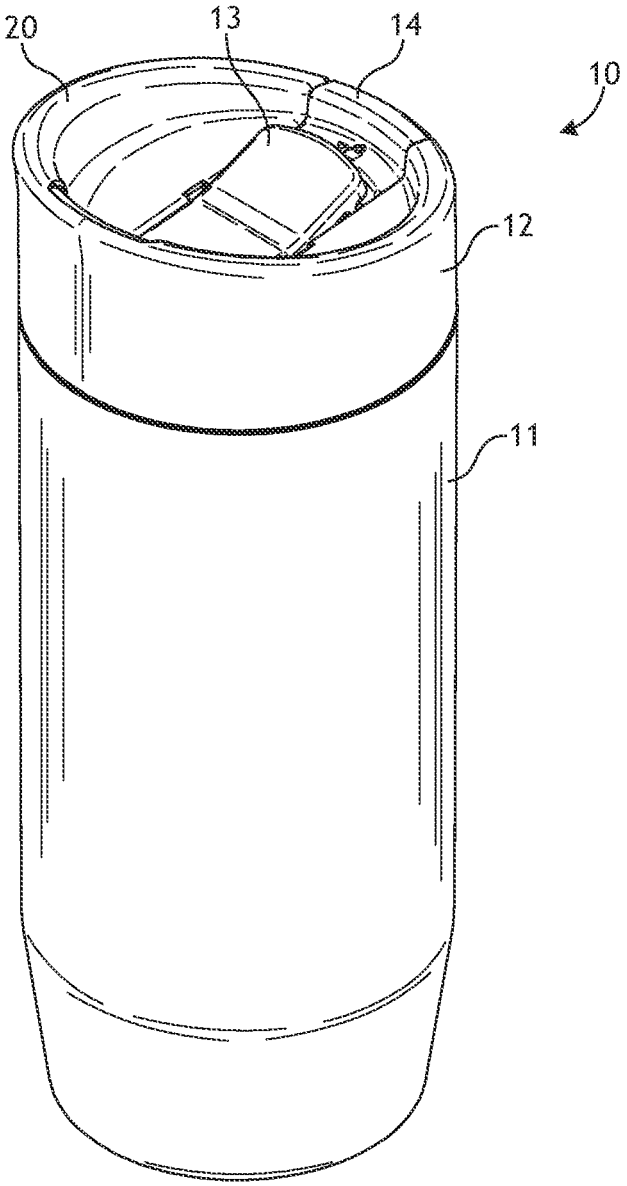
FIG. 1 is a perspective view of an embodiment of a drinking vessel with a lid and a locking cover.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined by the appended claims.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meeting, i.e., a meaning other than that understood by skilled artisans, such a special definition will be expressly set forth in the specification in a definitional manner that directly and unequivocally provides the special definition for the term or phrase.

The present embodiments describe a drinking vessel with a lid and a locking cover. FIG. 1 is a perspective view of one embodiment 10 of a drinking vessel with a lid and a locking cover. The vessel combination includes container 11 and lid 12. As shown in more detail in connection with FIG. 2, lid 12 preferably is attached to container 11 via a threaded connection, but also can be attached in other ways known to those skilled in the art, such as snap-on or other substantially leak-proof manners. Container 11 can be made from any suitable material, including vacuum-sealed layers (shown in more detail in FIGS. 4 and 5) to preserve the temperature of the container's contents. Bumper guard 15 (shown in FIGS. 4 and 5) can be formed from a material different from that of container 11. In one embodiment it is affixed to or otherwise integrated onto the bottom of container 11 in order to provide a skid-proof surface, a scratch-proof surface, and/or one that inhibits condensation, thereby protecting the surface on which vessel combination is placed.

Lid 12 includes one or more openings. As shown in connection with an exemplary embodiment of FIG. 18, lid 12 includes container opening 16 and vent opening 17. FIG. 18 is exemplary and those skilled in the art will appreciate that lid 12 can include one or more openings and need not include two openings. Further, the container and vent openings can be combined such that they function collectively to allow the container contents to exit the container while the opening simultaneously operates as a vent to equalize the pressure inside and outside the drinking vessel. The exemplary container opening 16 and vent opening 17 are further illustrated in FIGS. 7, 9, and 14-17.

Lid 12 further includes one or more covers 13. An exemplary embodiment of cover 13 is shown in FIGS. 1, 2, 7, and 9-18. As shown, cover 13 can be generally centrally located in the top of lid 12 and functions to cover one or more openings in lid 12. While the described exemplary embodiments show cover 13 covering both illustrated openings in lid 12, it should be noted that cover 13 could also cover only one such opening. As also illustrated (see FIG. 18), cover 13 may include one or more pivot pins 18 that are respectively inserted in one or more pivot receptacles 19 in lid 12 so as to allow cover 13 to rotate about the axis formed by its one or more pivot pins 18. Those skilled in the art will appreciate that other mechanisms could be used to couple cover 13 to lid 12 so as to allow cover 13 to assume at least a first position in which it seals one or more openings in lid 12 and a second position in which it does not seal one or more openings in lid 12. In its first position, cover 13 substantially does not allow the container's contents to exit at least one of its associated openings, whereas in its second position cover 13 allows the container's contents to exit at least one of its associated openings.

Movement of cover 13 relative to the one or more openings in lid 12 (i.e., between its first and second positions) is further facilitated by the shape of cover 13 and the location of pivot pin(s) 18. Specifically, as shown in the various Figures, cover 13 may include one end raised relative to its opposite end. Likewise, the more distant pivot pin 18 is located from the end of cover 13 that seals the one or more openings in lid 12, the less cover 13 will have to be pivoted (or displaced) to move cover 13 between its first and second positions.

Lid 12 further includes one or more adjustable locks 14. An exemplary embodiment of adjustable lock 14 is shown in FIGS. 1, 2, 7, and 9-18. As shown, adjustable lock 14 can be generally located on and form part of the edge of lid 12, and it functions (depending on its adjusted position) to at least either allow cover 13 to move between its first and second position or not allow cover 13 to move between its first and second position. For example, when adjustable lock 14 is adjusted to be in the position shown in FIGS. 1, 2, 9-11, 13-15, and 17, its co-functioning affect on cover 13 allows cover 13 to move between its first and second position. When adjustable lock 14 is adjusted to be in the position shown in FIGS. 12 and 16, its co-functioning affect on cover 13 prevents cover 13 from moving between its first and second position. In this manner, adjustable lock 14 is said to have a first (or closed) position in which it prevents cover 13 from moving between its first and second position, thereby "locking" cover 13 in its first position and substantially preventing the container's contents from exiting at least one of its associated openings, and a second (or open) position in which it allows cover 13 to move between its first and second position, thereby allowing cover 13 to be positioned in its second position where the container's contents are allowed to exit at least one of its associated openings. As also illustrated, adjustable lock 14 also can be adjusted to be in the position shown in FIGS. 13 and 17, which as described above has a co-functioning affect on cover 13 that allows cover 13 to move between its first and second position. This adjusted position is said to be a "cleaning" position since it exposes more of the lock, as well as the underside of the cover, so that such areas can be better cleaned of debris or other contaminants.

Those skilled in the art will appreciate that adjustable lock 14 and its co-functioning affect on cover 13 is not limited to the specific locations, structures, and/or interrelationships described here or otherwise illustrated in the accompanying Figures. Instead, other locking mechanisms can be employed such that cover 13 is either allowed to move between its first and second position or not move between its first and second position.

Lid 12 further includes raised rim 20, which substantially (in combination with a raised edge of adjustable lock 14 if adjustable lock 14 is located as shown) encircles the top edge of lid 12 so as to prevent any spillage of the contents from container 11 from escaping the top edge of drinking vessel 10. In other words, in this particular exemplary embodiment, the container opening 16 (and vent opening 17 if provided) is set in the lid below the top most surface of lid 12 and is substantially encircled by raised rim 20 to reduce spillage outside drinking vessel 10.

Figure 2:
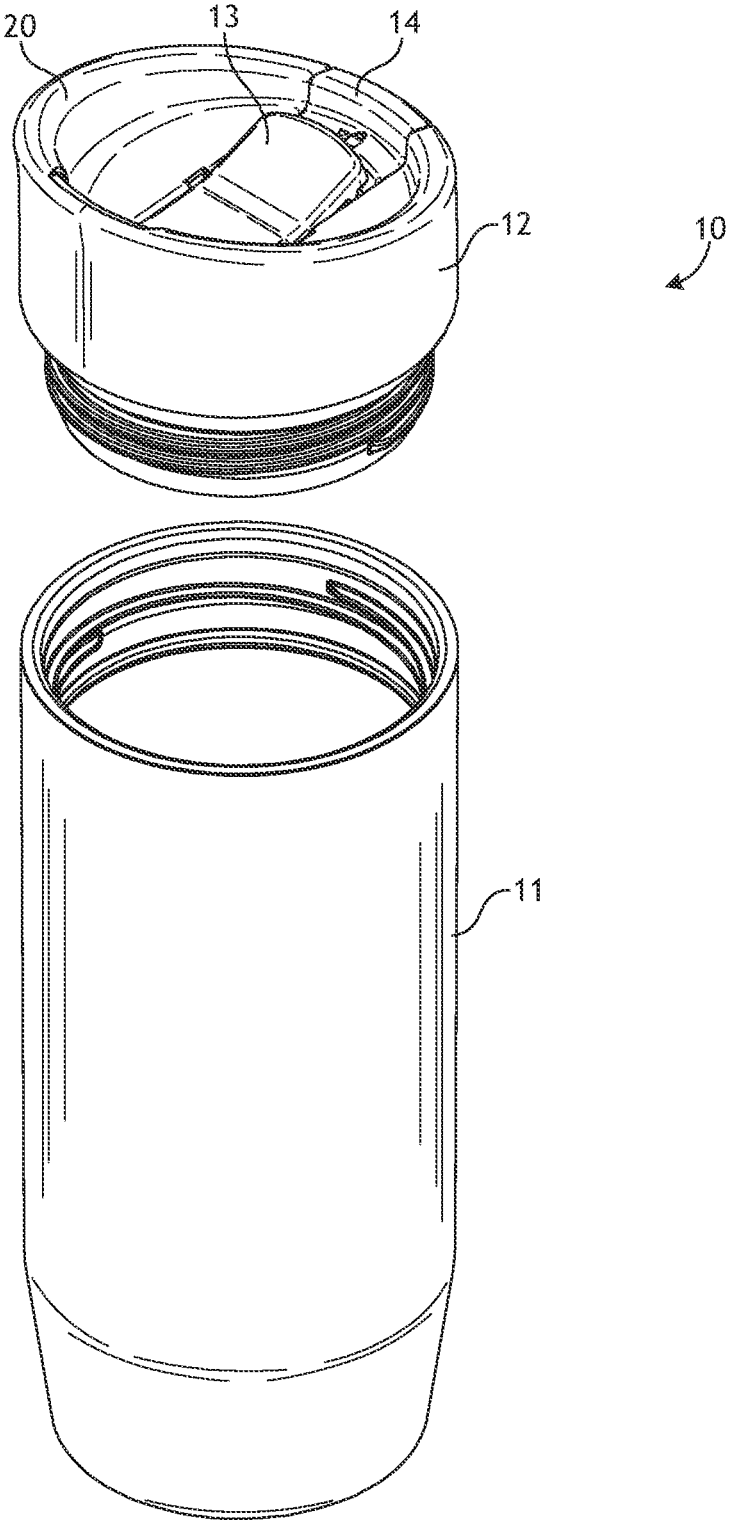
FIG. 2 is a perspective view of an embodiment of a drinking vessel with a lid and a locking cover, with lid removed in an exploded view.

FIG. 2 is a perspective view of an embodiment of a drinking vessel with a lid and a locking cover 10, with the lid 12 removed in an exploded view. As shown, the combination includes at least container 11 and lid 12, where the embodiment illustrates lid 12 preferably being attached to container 11 via a threaded connection, but also can be attached in other ways known to those skilled in the art, such as snap-on or other substantially leak-proof manners.

Figure 3:
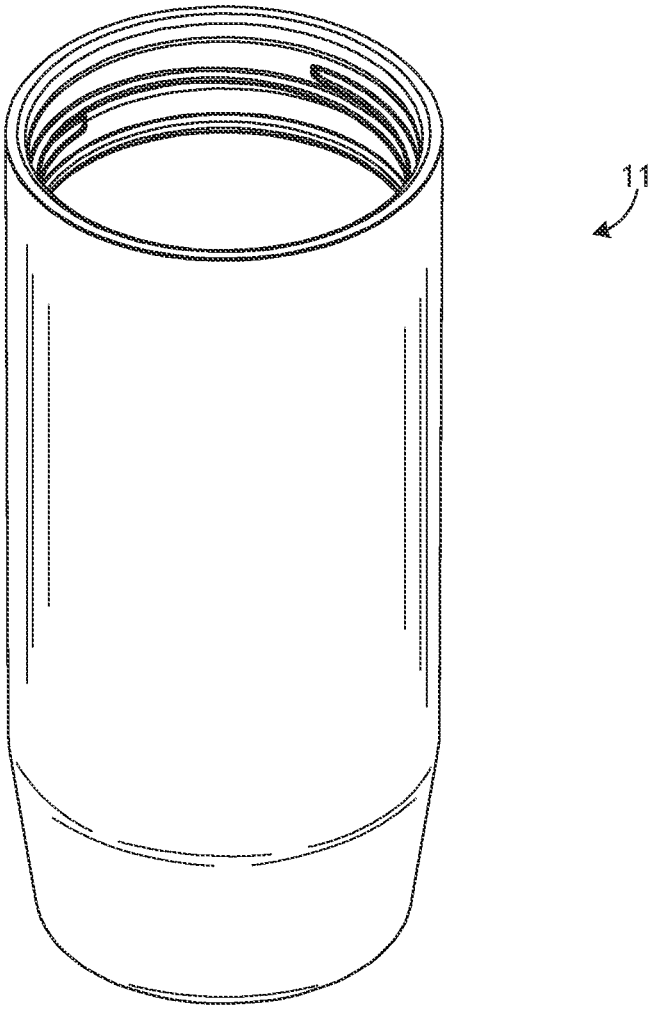
FIG. 3 perspective view of an embodiment of a container for a drinking vessel.
Figure 4:
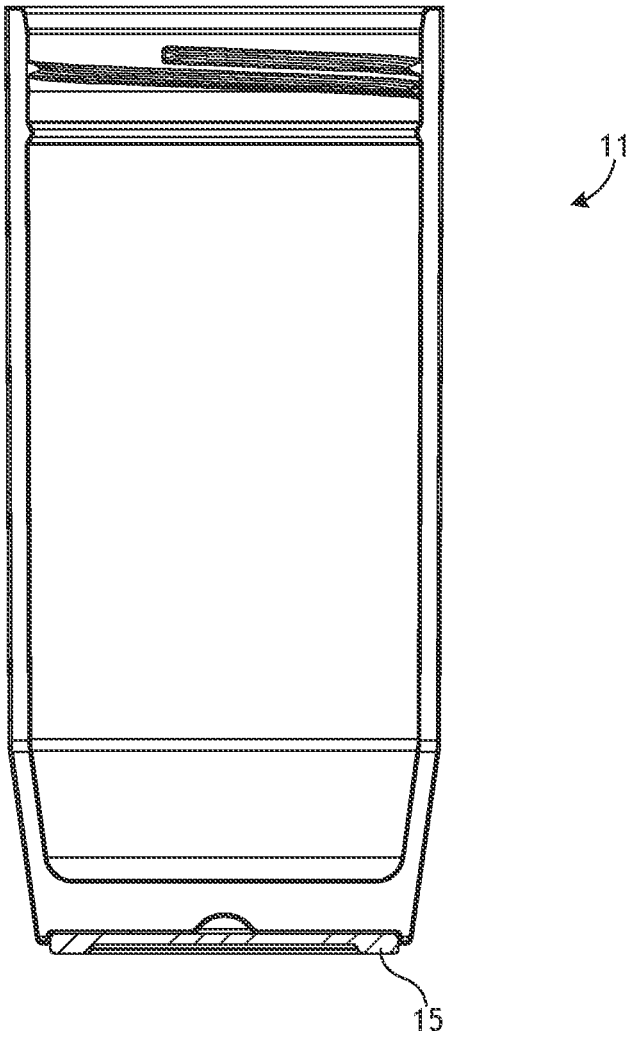
FIG. 4 is a cross section of an embodiment of a container for a drinking vessel.
Figure 5:
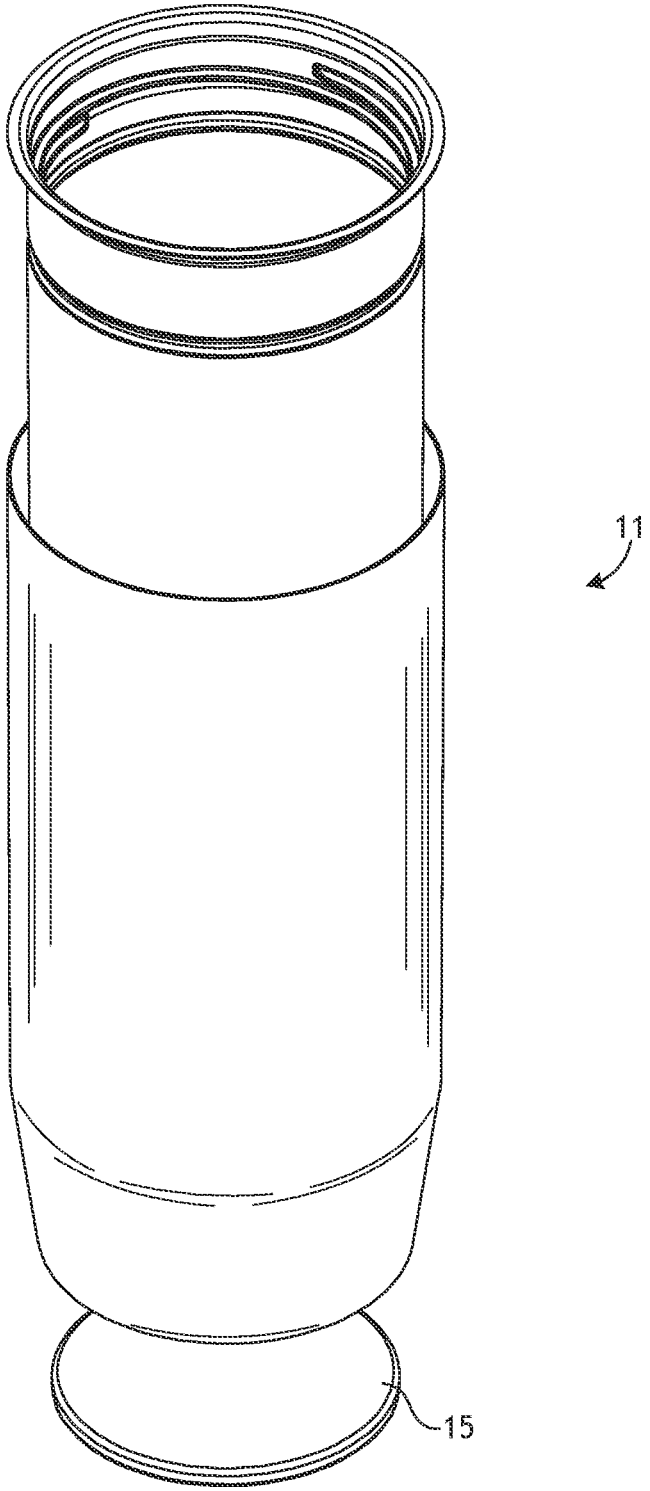
FIG. 5 is a perspective view of an embodiment of a container for a drinking vessel shown in an exploded view.

FIG. 3 perspective view of an embodiment of container 11. FIG. 4 is a cross section of an embodiment of container 11. Those skilled in the art will recognize that FIG. 4 illustrates a vacuum sealed embodiment but that other embodiments are possible and are within the spirit and scope of the present invention. FIG. 4 also shows bumper guard 15, as also described above. FIG. 5 is a perspective view of container 11 shown in an exploded view, thereby better illustrating the vacuum sealed nature of this embodiment and the placement/location of bumper guard 15.

Figure 6:
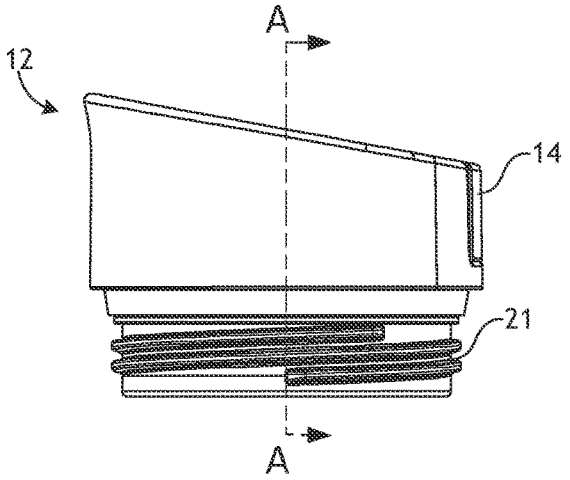
FIG. 6 is a right side view of an embodiment of a lid for a drinking vessel, where the lid includes a locking cover.

FIG. 6 is a right side view of an embodiment of lid 12. FIG. 6 further illustrates threaded connection 21 used to connect lid 12 to container 11. FIG. 6 also illustrates adjustable lock 14, which is shown in its open position, i.e., it is adjusted to be substantially flush with the outside surface of lid 12.

Figure 7:
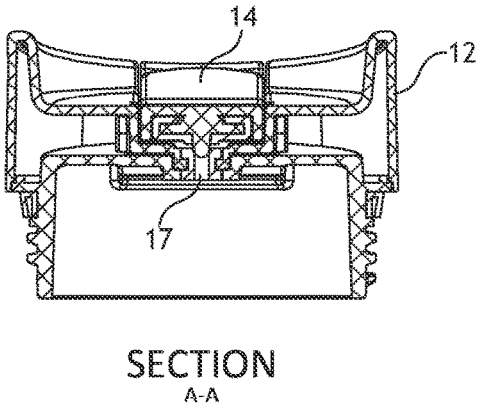
FIG. 7 is a cross section of an embodiment of a lid for a drinking vessel taken along the cross sectional line A-A in FIG. 6.

FIG. 7 is a cross section of an embodiment of lid 12 taken along the cross sectional line A-A in FIG. 6. Here, adjustable lock 14 is once again visible, as is vent opening 17. In this embodiment (as also illustrated in FIG. 18), vent opening 17 is positioned substantially in the center of lid 12. Those skilled in the art will appreciate that other locations on lid 12 are possible for vent opening 17. An advantage, however, to the illustrated location of vent opening 17 is its relative location to container opening 16 (see FIG. 18). Given the relative location of vent opening 17 and container opening 16, both openings can be covered by the same cover 13.

Figure 8:
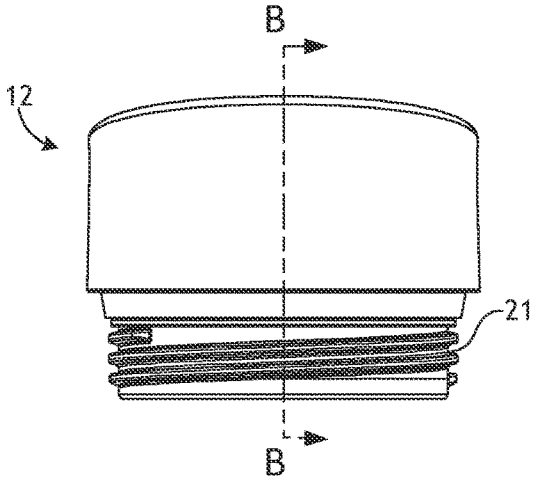
FIG. 8 is a front side view of an embodiment of a lid for a drinking vessel, where the lid includes a locking cover.

FIG. 8 is a front side view of an embodiment of lid 12. FIG. 8 further illustrates threaded connection 21 used to connect lid 12 to container 11.

Figure 9:
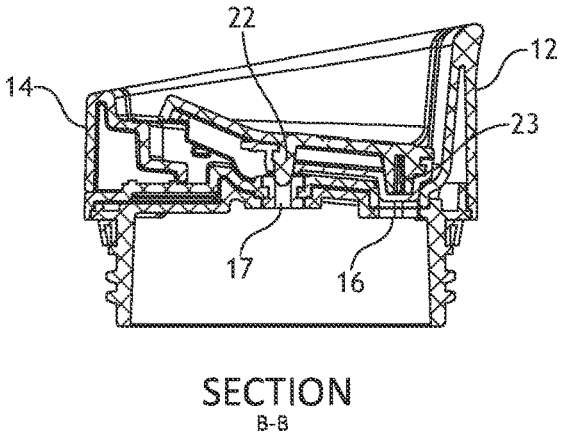
FIG. 9 is a cross section of an embodiment of a lid for a drinking vessel taken along the cross sectional line B-B in FIG. 8, where the lid's cover is in a closed position and its lock is in an open position.

FIG. 9 is a cross section of an embodiment of lid 12 taken along the cross sectional line B-B in FIG. 8. Here, adjustable lock 14 is once again visible, as is vent opening 17 and container opening 16. Also illustrated are vent seal 22 and opening seal 23. Vent seal 22 is located on the underside of cover 13 and positioned there so that vent seal 22 substantially seals vent opening 17 when cover 13 is in its first position. Likewise, opening seal 23 is located on the underside of cover 13 and positioned there so that opening seal 23 substantially seals container opening 16 when cover 13 is in its first position. While FIG. 9 shows cover 13 in its first position, those skilled in the art will appreciate that because adjustable lock 14 is in its open position, cover 13 is able to rotate about the axis formed by pivot pin(s) 18 (as mounted in pivot receptacle(s) 19), thereby allowing cover 13 to move between is first and second positions.

Figure 10:
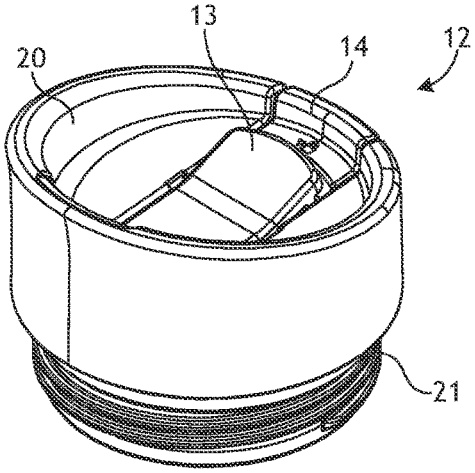
FIG. 10 is a perspective view of an embodiment of a lid for a drinking vessel, where the lid's cover is in a closed position and its lock is in an open position.
Figure 11:
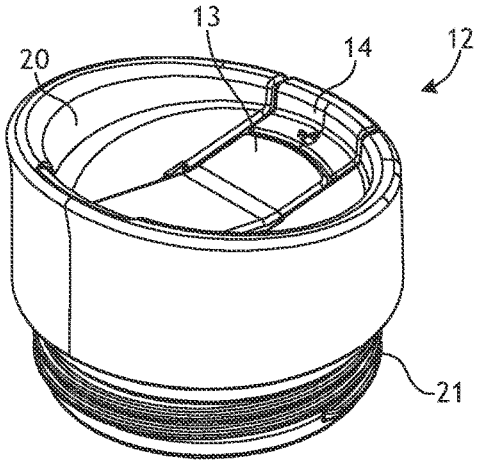
FIG. 11 is a perspective view of an embodiment of a lid for a drinking vessel, where the lid's cover is in an open position and its lock is in an open position.
Figure 12:
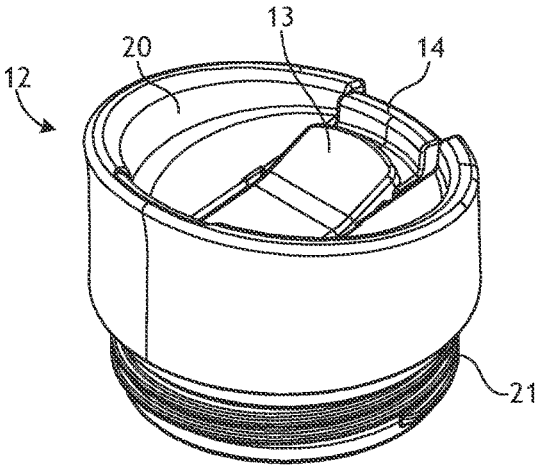
FIG. 12 is a perspective view of an embodiment of a lid for a drinking vessel, where the lid's cover is in a closed position and its lock is in a closed position.
Figure 13:
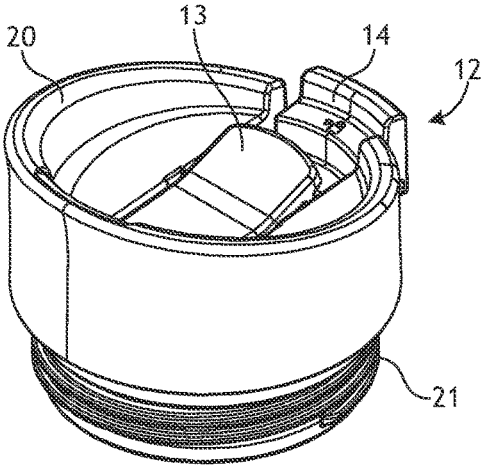
FIG. 13 is a perspective view of an embodiment of a lid for a drinking vessel, where the lid's cover is in a closed position and its lock is in a cleaning position.

FIGS. 10-13 illustrate exemplary embodiments of lid 12, where cover 13 and adjustable lock 14 are in various of their possible positions. Specifically, FIG. 10 is a perspective view of an embodiment of lid 12, where cover 13 is in its first/closed position and adjustable lock 14 is in its open position. FIG. 11 is a perspective view of an embodiment of lid 12, where cover 13 is in its second/open position and adjustable lock 14 is in its open position. As such, it can be seen that cover 13 can move between its first and second position when adjustable lock 14 is in its open position. FIG. 12 is a perspective view of an embodiment of lid 12, where cover 13 is in its first/closed position and adjustable lock 14 is in its closed/locked position. In this manner, cover 13 is precluded from moving between is first and second position and, likewise, the contents of drinking vessel 10 are precluded from spilling or otherwise exiting the vessel. Finally, FIG. 13 is a perspective view of an embodiment of lid 12, where cover 13 is in its first/closed position and adjustable lock 14 is in its cleaning position. As explained above and as shown in FIG. 13, cover 13 is capable of moving between its first and second positions when adjustable lock 14 is in its cleaning position.

Figure 14:
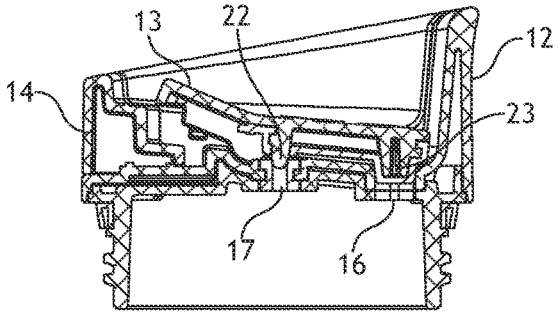
FIG. 14 is a cross section of an embodiment of a lid for a drinking vessel, where the lid's cover is in a closed position and its lock is in an open position.
Figure 15:
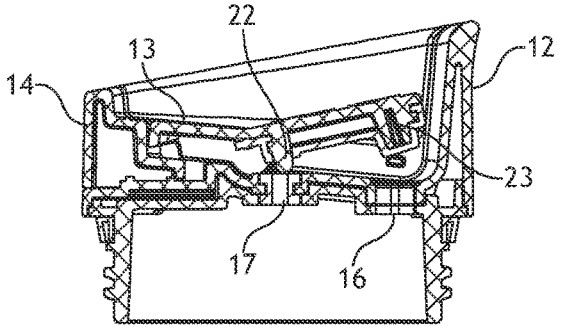
FIG. 15 is a cross section of an embodiment of a lid for a drinking vessel, where the lid's cover is in an open position and its lock is in an open position.
Figure 16:
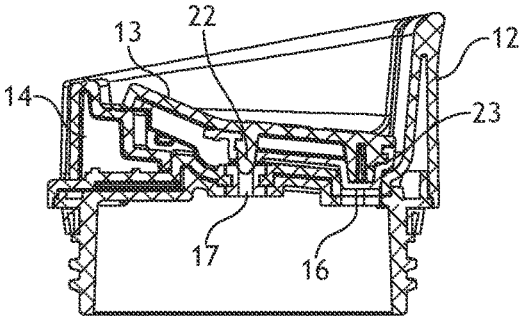
FIG. 16 is a cross section of an embodiment of a lid for a drinking vessel, where the lid's cover is in a closed position and its lock is in a closed position.
Figure 17:
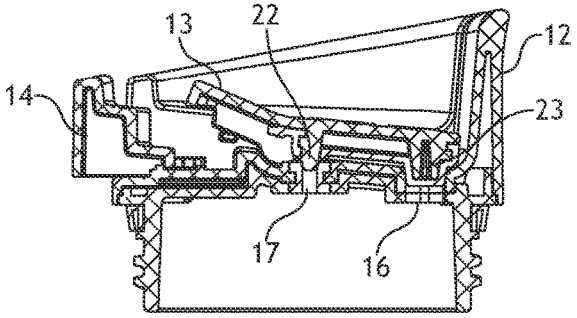
FIG. 17 is a cross section of an embodiment of a lid for a drinking vessel, where the lid's cover is in a closed position and its lock is in a cleaning position.
Figure 18:
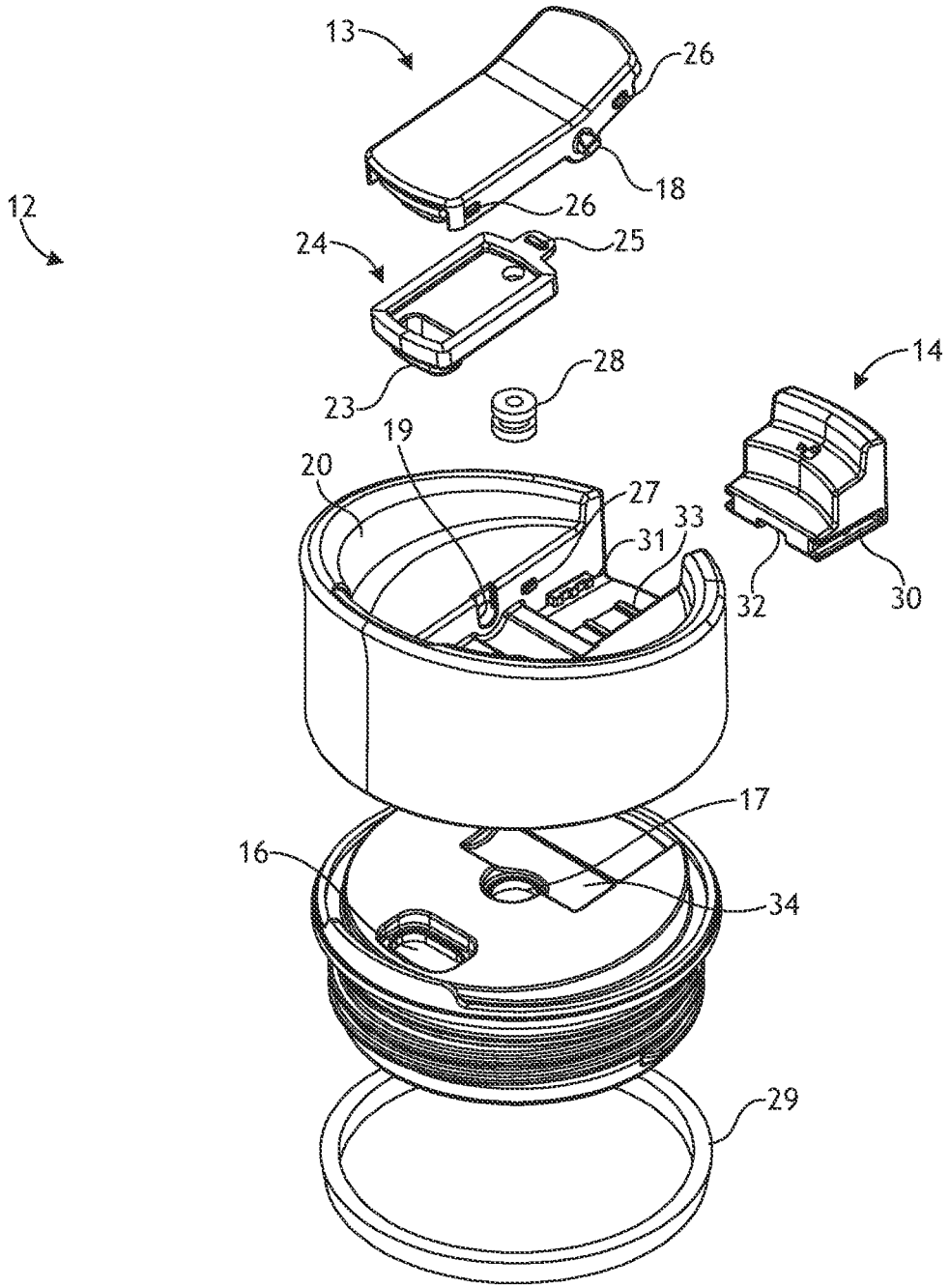
FIG. 18 is an exploded view of an embodiment of a lid for a drinking vessel, where the lid includes a locking cover.

FIGS. 14-17 illustrate exemplary, cross-sectional embodiments of lid 12, where cover 13 and adjustable lock 14 are in various of their possible positions. Specifically, FIG. 14 is a cross-sectional view of an embodiment of lid 12, where cover 13 is in its first/closed position and adjustable lock 14 is in its open position. FIG. 15 is a cross-sectional view of an embodiment of lid 12, where cover 13 is in its second/open position and adjustable lock 14 is in its open position. As such, it can be seen that cover 13 can move between its first and second position when adjustable lock 14 is in its open position. FIG. 16 is a cross-sectional view of an embodiment of lid 12, where cover 13 is in its first/closed position and adjustable lock 14 is in its closed/locked position. In this manner, cover 13 is precluded from moving between is first and second position and, likewise, the contents of drinking vessel 10 are precluded from spilling or otherwise exiting the vessel. (Indeed, note that vent seal 22 is sealing vent opening 17 and that opening seal 23 is sealing container opening 16.) Finally, FIG. 17 is a cross-sectional view of an embodiment of lid 12, where cover 13 is in its first/closed position and adjustable lock 14 is in its cleaning position. As explained above and as shown in FIG. 17, cover 13 is capable of moving between its first and second positions when adjustable lock 14 is in its cleaning position.

FIG. 18 is an exploded view of an embodiment of lid 12. As shown, lid 12 can include cover 13, where cover 13 includes one or more pivot pins 18 mounted or integrally attached thereto. While not shown in FIG. 18, it is contemplated that this embodiment includes another pivot pin 18 on the side of cover 13 opposite the visible pivot pin 18. In this context, the pivot pin 18 not visible would be rotatably inserted in pivot receptacle 19 shown in FIG. 18, whereas the visible pivot pin 18 would be rotatably inserted in a pivot receptacle (in lid 12) opposite visible pivot receptacle 19. In this manner, and as described above, cover 13 rotates (through user manipulation) about the axis formed by pivot pins 18 between its first and second positions.

As further shown by FIG. 18, cover 13 further includes one or more detents 26. Each detent 26 is a small protrusion from cover 13 that mates with a similarly sized detent receptacle in lid 12, one such detent receptacle 27 being shown in FIG. 18. While not shown in FIG. 18, it is contemplated that this embodiment includes another detent 26 on the side of cover 13 opposite each visible detent 26. In this manner, each detent on cover 13 will mate with a corresponding detent receptacle 27 in lid 12 such that the rear pair of detents and detent receptacles operate to keep cover 13 in its second/open position, whereas the forward pair of detents and detent receptacles operate to keep cover 13 in its first/closed position. Only a modicum of user force is required to lodge or dislodge the detents from their receptacles. Moreover, as those skilled in the art will appreciate, the existence of and/or number of detents and detent receptacles is a design choice made known by the present disclosure.

FIG. 18 also illustrates cover adaptor 24. Cover adaptor 24 includes opening seal 23 and tab 25, as shown. Cover adaptor 24 is preferably made from a elastic material so that it can be stretched (slightly) to conform to and cover the underside of cover 13. Not only does the material make of up adaptor 24 allow it to be removable from cover 13 (and thereby more effectively cleaned), it allows opening seal 23 to more snuggly fit into or otherwise seal container opening 16 (when cover 13 is in its first/closed position), thereby better ensuring that the contents of drinking vessel 10 do not spill or otherwise inadvertently escape. Tab 25 assists in applying and removing cover adaptor 24 to/from cover 13. As those skilled in the art will appreciate, while cover 13 and cover adaptor 24 are shown as separate components, other embodiments within the scope of the present invention include those in which cover 13 and cover adaptor 24 are a single, unitary component.

FIG. 18 also illustrates vent adaptor 28. Vent adaptor 28 preferably is a rubber or other deformable material that is removably inserted into vent opening 17 so that when vent seal 22 contacts vent adaptor 28 (i.e., when cover 13 is in its first/closed position) the seal between the two is substantially airtight, but when cover 13 is in its second/open position an air passage exists between the internal and external regions of drinking vessel 10 so as to "vent" the vessel's contents to the outside atmosphere. As those skilled in the art will appreciate, vent adaptor 28 is optional and/or could be formed of other known, suitable materials.

FIG. 18 also illustrates adjustable lock 14. In an exemplary embodiment, adjustable lock 14 preferably is a stair step shaped component. The first or lower stair step portion is sized to receive one end of cover 13 when cover 13 is in its second/open position and adjustable lock 14 is in its open position. In this manner and as described in more detail above, cover 13 is allowed to move between its first and second positions when adjustable lock 14 is in its open position. The second or middle stair step portion of adjustable lock 14 is sized to fit under one end of cover 13 when cover 13 is in its first/closed position and adjustable lock 14 is in its closed/locked position. In this manner and as described in more detail above, cover 13 is prevented (by the second or middle stair step portion of adjustable lock 14) from moving between its first and second positions when adjustable lock 14 is in its closed/locked position.

As further shown in the exemplary embodiment of FIG. 18, adjustable lock 14 may include one or more side rail slots 30 preferably located on the lower side portion thereof. Each side rail slot 30 is intended to receive side rail 31 mounted on lid 12 to enable adjustable lock 14 to slide (or otherwise move) between its closed, open, and cleaning positions. As further illustrated (partially) by FIG. 18, side rail slot 30 may include a detent and side rail 31 may include two separate detent receptacles such that the corresponding location and combination of each detent and each detent receptacle operate to hold adjustable lock 14 in its closed and open position, respectively. As those skilled in the art will appreciate, more (or less) detents and detent receptacles could be used to hold adjustable lock 14 in more (or less) positions.

As further shown in the exemplary embodiment of FIG. 18, adjustable lock 14 may include one or more middle rail slots 32 preferably located on the lower middle portion thereof. Each middle rail slot 32 is intended to receive middle rail 33 mounted on lid 12 to enable adjustable lock 14 to slide (or otherwise move) between its closed, open, and cleaning positions. As further illustrated (partially) by FIG. 18, middle rail slot 32 may include a detent and middle rail 33 may include at least two separate detent receptacles such that the corresponding location and combination of the detent and each detent receptacle operate to hold adjustable lock 14 in its open and cleaning position, respectively. As those skilled in the art will appreciate, more (or less) detents and detent receptacles could be used to hold adjustable lock 14 in more (or less) positions.

As further shown in the exemplary embodiment of FIG. 18, lid 12 may include cradle area 34. Cradle area 34 is a concave region on the surface of lid 12 that receives the convex portion of cover 13 below pivot pin(s) 18. The convex and concave portions are intended to receive one another shape-wise so that cover 13 may more freely and securely (i.e., without lateral movement) move between its first and second positions.

As further shown in the exemplary embodiment of FIG. 18, lid 12 may include seal 29 to better seal the interface between lid 12 and container 11, thereby ensuring a more airtight and leak-proof seal.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. An apparatus, comprising:

a container for retaining liquids;

a lid attached to the container, wherein the lid includes at least one opening for dispensing the liquids, wherein the opening includes a topside facing an outside of the container and a bottom-side facing an inside of the container;

the lid further including a cover attached to the lid to move between at least a first position and a second position, wherein the cover seals the topside of the at least one opening in the first position and the cover allows liquids to be dispensed from the at least one opening in the second position;

the lid further including an adjustable lock attached to the lid to move between at least a first and a second position, wherein the adjustable lock prevents the cover from moving between its first and second position when the adjustable lock is in its first position and the adjustable lock allows the cover to move between its first and second position when the adjustable lock is in its second position, whereby the cover is attached to the lid, and the adjustable lock is attached to the lid, such that the cover and the adjustable lock move independently of each other when each is attached to the lid.

2. The apparatus of claim 1 wherein the lid further includes a raised rim around a periphery of the lid.

3. The apparatus of claim 2 wherein a portion of the raised rim includes the adjustable lock.

4. The apparatus of claim 3 wherein a portion of the raised rim includes the adjustable lock when the adjustable lock is in its second position.

5. The apparatus of claim 4 wherein the adjustable lock is further configured and attached to the lid to move between the first, the second position, and a third position.

6. The apparatus of claim 5 wherein the adjustable lock is configured to allow the cover to move between its first and second position when the adjustable lock is in its third position.

7. The apparatus of claim 6 wherein the cover is configured to include at least one pivot pin and the lid is configured to include at least one pivot receptacle, whereby the cover is attached to the lid by the pivot pin and pivot receptacle, and the pivot pin and pivot receptacle permit the cover to move between at least its first position and second position.

8. The apparatus of claim 7 wherein the cover has a first end and a second end, and the at least one pivot pin is not equidistant between said first and second end.

9. The apparatus of claim 8 wherein the first end of the cover is raised relative to the second end of the cover.

10. The apparatus of claim 9 wherein the adjustable lock includes a stair step shaped portion.

11. The apparatus of claim 10 wherein the adjustable lock includes at least one side rail slot and the lid included at least one side rail, whereby the side rail slot and the side rail enable the adjustable lock to move between at least its first and its second position.

12. The apparatus of claim 11 wherein the adjustable lock is configured to allow the cover to be removed from the lid for cleaning when the adjustable lock is in its third position.

* * * * *